US008376540B2

(12) United States Patent
Okazawa

(10) Patent No.: US 8,376,540 B2
(45) Date of Patent: Feb. 19, 2013

(54) LIQUID JET HEAD

(75) Inventor: Noriaki Okazawa, Nagano-ken (JP)

(73) Assignee: Seiko Epson Corporation (HQ), Tokyo (JP)

( * ) Notice: Subject to any disclaimer, the term of this patent is extended or adjusted under 35 U.S.C. 154(b) by 0 days.

(21) Appl. No.: 13/463,736

(22) Filed: May 3, 2012

(65) Prior Publication Data

US 2012/0218358 A1 Aug. 30, 2012

Related U.S. Application Data

(60) Continuation of application No. 13/163,429, filed on Jun. 17, 2011, now Pat. No. 8,192,007, which is a continuation of application No. 12/609,233, filed on Oct. 30, 2009, now Pat. No. 7,984,982, which is a continuation of application No. 11/797,651, filed on May 4, 2007, now Pat. No. 7,631,964, which is a continuation of application No. 11/046,734, filed on Feb. 1, 2005, now Pat. No. 7,229,162, which is a division of application No. 10/264,323, filed on Oct. 4, 2002, now Pat. No. 7,070,263.

(30) Foreign Application Priority Data

Oct. 4, 2001 (JP) ..... 2001-309106
Sep. 5, 2002 (JP) ..... 2002-260048
Oct. 3, 2002 (JP) ..... 2002-291152

(51) Int. Cl.
*B41J 2/17* (2006.01)

(52) U.S. Cl. ..... 347/94

(58) Field of Classification Search ..... 347/84, 347/85, 94
See application file for complete search history.

(56) References Cited

U.S. PATENT DOCUMENTS

| | | | | |
|---|---|---|---|---|
| 5,689,291 | A | 11/1997 | Tence et al. | |
| 5,736,993 | A | 4/1998 | Regimbal et al. | |
| 6,109,736 | A | 8/2000 | Miyata et al. | |
| 6,270,207 | B1 | 8/2001 | Sasaki | |
| 6,276,785 | B1 | 8/2001 | Shinada et al. | |
| 6,332,672 | B1 | 12/2001 | Yazaki et al. | |
| 6,698,872 | B2 | 3/2004 | Hou et al. | |
| 6,840,603 | B2 | 1/2005 | Barinaga et al. | |
| 7,168,795 | B2 | 1/2007 | Shimizu | |
| 8,192,007 | B2 * | 6/2012 | Okazawa | 347/94 |

FOREIGN PATENT DOCUMENTS

| | | |
|---|---|---|
| JP | H03-136862 | 6/1991 |
| JP | H09-314832 | 12/1997 |
| JP | H10-278920 | 10/1998 |
| JP | H11-058739 | 3/1999 |
| JP | H11-227186 | 8/1999 |
| JP | 2000-006397 | 1/2000 |
| JP | 2000-52553 | 2/2000 |
| JP | 2000-218789 | 8/2000 |
| JP | 2002-127407 | 5/2002 |

* cited by examiner

*Primary Examiner* — An Do
(74) *Attorney, Agent, or Firm* — Sughrue Mion, PLLC

(57) ABSTRACT

A liquid jet apparatus is provided. The liquid jet apparatus includes a first damper chamber and a second damper chamber, a release path operatively associated with both the first damper chamber and the second damper chamber, and a control path connecting the first damper chamber, the second damper chamber, and the release path to each other.

13 Claims, 18 Drawing Sheets

1 flow passage unit
2 head case
3 nozzle plate
4 flow channel substrate
5 diaphragm
5C pad
6 piezoelectric transducers
7 pressure generation chamber
8 nozzle opening
9 ink reservoir
10 ink supply path
11 fixed plate
12 damper chamber
13 flexible printed circuit
14A control path
14B release path
14I diaphragm-side cavity
15 ink refilling tube
16 through spaces

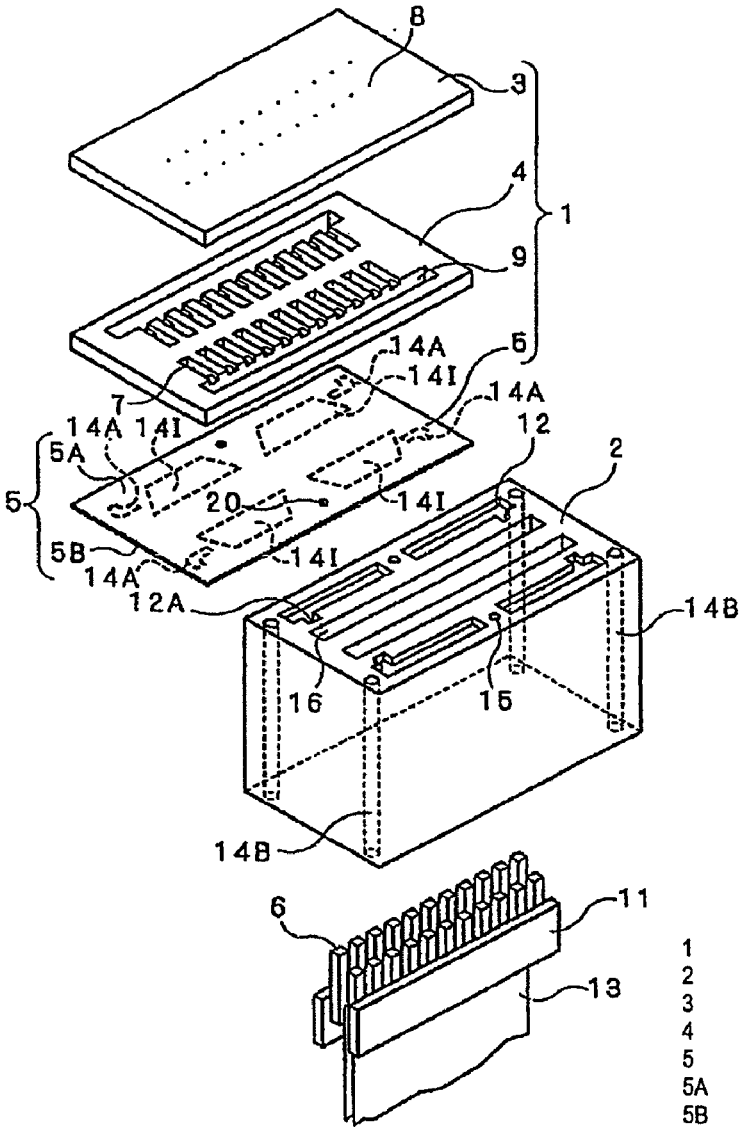

Fig. 1

| | |
|---|---|
| 1 | flow passage unit |
| 2 | head case |
| 3 | nozzle plate |
| 4 | flow channel substrate |
| 5 | diaphragm |
| 5A | resin thin film |
| 5B | metal thin film |
| 6 | piezoelectric transducers |
| 7 | pressure generation chamber |
| 8 | nozzle opening |
| 9 | ink reservoir |
| 11 | fixed plate |
| 12 | damper chamber |
| 12A | connection cavity |
| 13 | flexible printed circuit |
| 14A | control path |
| 14B | release path |
| 14I | diaphragm-side cavity |
| 15 | ink refilling tube |
| 16 | through spaces |
| 20 | ink refilling holes |

| | |
|---|---|
| 1 | flow passage unit |
| 2 | head case |
| 3 | nozzle plate |
| 4 | flow channel substrate |
| 5 | diaphragm |
| 5C | pad |
| 6 | piezoelectric transducers |
| 7 | pressure generation chamber |
| 8 | nozzle opening |
| 9 | ink reservoir |
| 10 | ink supply path |
| 11 | fixed plate |
| 12 | damper chamber |
| 13 | flexible printed circuit |
| 14A | control path |
| 14B | release path |
| 14I | diaphragm-side cavity |
| 15 | ink refilling tube |
| 16 | through spaces |

| | |
|---|---|
| 2 | head case |
| 12 | damper chamber |
| 12A | connection cavity |
| 14A | control path |
| 14B | release path |
| 14I | diaphragm-side cavity |
| 16 | through spaces |

| | |
|---|---|
| 5 | diaphragm |
| 12 | damper chamber |
| 12A | connection cavity |
| 14 | external communication path |
| 14A | control path |
| 14B | release path |
| 14C | end of control path |
| 14D | end of control path |

| | |
|---|---|
| 5 | diaphragm |
| 5A | resin thin film |
| 5B | metal thin film |
| 14A | control path |

| | |
|---|---|
| 2 | head case |
| 5 | diaphragm |
| 5A | resin thin film |
| 5B | metal thin film |
| 12 | damper chamber |
| 12A | connection cavity |
| 14 | external communication path |
| 14A | control path |
| 14B | release path |
| 14C | end of control path |
| 14I | diaphragm-side cavity |

| | |
|---|---|
| 2 | head case |
| 5A | resin thin film |
| 5B | metal thin film |
| 12 | damper chamber |
| 14A | control path |
| 14B | release path |

| | |
|---|---|
| 2 | head case |
| 5A | resin thin film |
| 5B | metal thin film |
| 12 | damper chamber |
| 12A | connection cavity |
| 14A | control path |
| 14B | release path |

| | |
|---|---|
| 2 | head case |
| 12 | damper chamber |
| 12A | connection cavity |
| 14A | control path |
| 14B | release path |

| | |
|---|---|
| 2 | head case |
| 5A | resin thin film |
| 5B | metal thin film |
| 12 | damper chamber |
| 12A | connection cavity |
| 13 | flexible printed circuit |
| 14 | external communication path |
| 14A | control path |
| 14B | release path |

| | |
|---|---|
| 5B | metal thin film |
| 12 | damper chamber |
| 14A | control path |
| 14B | release path |
| 17 | cavities |
| 17A | storage cavities |

| | |
|---|---|
| 5B | metal thin film |
| 12 | damper chamber |
| 12A | connection cavity |
| 14A | control path |
| 14B | release path |
| 17 | cavities |

| | |
|---|---|
| 5 | diaphragm |
| 5B | metal thin film |
| 14A | control path |
| 14B | release path |
| 17C | hooked end |

| | |
|---|---|
| 5B | metal thin film |
| 14A | control path |
| 14B | release path |
| 18 | orifice |
| 19 | orifice element |

2 head case
12 damper chamber
12A connection cavity
14B release path
14I diaphragm-side cavity
16 through spaces
24A control path
24E bonding pad
24F right side surface of the control path
24G left side surface of the diaphragm-side cavity
24H channels
24I diaphragm-side cavity
27 adhesive cavities

| | |
|---|---|
| 12 | damper chamber |
| 12A | connection cavity |
| 14B | release path |
| 24F | right side surface of the control path |
| 24G | left side surface of the diaphragm-side cavity |
| 34D | diaphragm-side cavity |
| 34E | bonding pad |
| 34H | channels |

| | |
|---|---|
| 1 | flow passage unit |
| 2 | head case |
| 3 | nozzle plate |
| 4 | flow channel substrate |
| 5 | diaphragm |
| 5C | pad |
| 6 | piezoelectric transducers |
| 7 | pressure generation chamber |
| 8 | nozzle opening |
| 9 | ink reservoir |
| 10 | ink supply path |
| 11 | fixed plate |
| 12 | damper chamber |
| 13 | flexible printed circuit |
| 14 | external communication path |
| 15 | ink refilling tube |
| 16 | through spaces |

LIQUID JET HEAD

This is a continuation of U.S. application Ser. No. 13/163,429 filed on Jun. 17, 2011, now U.S. Pat. No. 8,192,007, which is a continuation of U.S. application Ser. No. 12/609,233, now U.S. Pat. No. 7,984,982, filed Oct. 30, 2009 which is a continuation of U.S. application Ser. No. 11/797,651, filed May 4, 2007, now U.S. Pat. No. 7,631,964, which is a continuation of application Ser. No. 11/046,734, filed Feb. 1, 2005, now U.S. Pat. No. 7,229,162, which is a divisional of U.S. application Ser. No. 10/264,323, filed Oct. 4, 2002, now U.S. Pat. No. 7,070,263, which claims priority from Japanese Patent Application Nos. 2001-309106, dated Oct. 4, 2001; 2002-260048, dated Sep. 5, 2002 and 2002-291152, dated Oct. 3, 2002. The entire disclosures of the prior applications are considered part of the disclosure of the accompanying continuation application and are hereby incorporated by reference.

BACKGROUND OF THE INVENTION

1. Field of the Invention

This present invention relates to a liquid jet head, and a liquid jet apparatus, such as a recording head for an ink jet recording apparatus, an electrode member ejection head for an electrode forming apparatus, an organic substance jet head for a bio chip manufacture apparatus, etc., in which liquid are ejected by deformation of piezoelectric elements formed on a surface of a diaphragm formed as a part of pressure generating chambers communicating with nozzle orifices from which liquid are ejected.

2. Description of the Related Art

A typical inkjet recording head (a kind of liquid jet head) using a longitudinally oscillating piezoelectric transducer (referred to below as simply a "recording head") has, as shown in FIG. 16, an ink path unit 1 in which a plurality of nozzle openings 8 and a pressure generation chamber 7 are formed, and a head case 2 to which this ink path unit 1 is bonded and in which piezoelectric transducers 6 are housed.

The ink path unit 1 is a laminar construction including a nozzle plate 3 in which the nozzle openings 8 are arranged in rows orthogonally to the recording medium surface, a flow channel substrate 4 in which a pressure generation chamber 7 is disposed communicating with each of the nozzle openings 8, and a diaphragm 5 covering the bottom opening of each pressure generation chamber 7. An ink reservoir 9 communicating with each pressure generation chamber 7 by way of ink supply path 10 and storing the ink supplied to each pressure generation chamber 7 is formed in the flow channel substrate 4. It should be noted that two sets of nozzle openings 8 and pressure generation chambers 7 are shown in the example in FIG. 16.

The head case 2 is made from synthetic resin with the piezoelectric transducers 6 disposed in through-spaces 16, which are vertically oriented as seen in the figure. The spaces 16 extend in line with the rows of nozzle openings 8, and there are two spaces 16 corresponding to the rows of the nozzle openings 8. The back end side of each piezoelectric transducer 6 is bonded to a fixed plate 11 affixed to the head case 2, and the front end side of each piezoelectric transducer 6 is bonded to a pad 5C on the bottom surface of the diaphragm 5.

The piezoelectric transducers 6 are forced to expand and contract longitudinally by applying a drive signal generated by a drive circuit (not shown in the figure) to the transducers 6 by way of flexible printed circuit 13. Expansion and contraction of the piezoelectric transducers 6 causes the pad 5C of the diaphragm 5 to vibrate and thereby change the pressure inside the pressure generation chamber 7 so that ink inside the pressure generation chamber 7 is discharged from the nozzle opening 8 as an ink droplet. Also shown in FIG. 16 is the ink refilling tube 15 for refilling the ink reservoir 9 with ink from an ink cartridge (not shown in the figure).

The diaphragm 5 in this example is made from a polyphenylene sulfide (PPS) film, and a damper chamber 12 for absorbing through the diaphragm 5 pressure change in the ink reservoir 9 during ink discharge is formed in the head case 2 at an appropriate position to the ink reservoir 9. If this damper chamber 12 is an independent space that does not communicate with the exterior, air inside the damper chamber 12 can dissolve into the ink through the diaphragm 5 made of PPS film, thereby lowering the pressure inside the damper chamber 12, increasing the tension of the diaphragm 5, and can thus easily make it difficult to achieve the desired damping effect. This pressure drop inside the damper chamber 12 is therefore prevented by opening an external communication path 14 passing from the inside surface of the damper chamber 12 toward and out the back side of the head case 2 so that the damper chamber 12 can communicate with the outside.

Problem to be Solved

A problem with the recording head described above is that the damper chamber 12 is open to the air. When the recording head is left unused or stored for a long time, water in the ink inside the ink reservoir 9 is therefore able to pass as water vapor through the PPS film diaphragm 5 and the viscosity of ink inside the ink reservoir 9 gradually increases. The ink can even dry to the point that clogging of the flow path cannot be corrected and ink cannot be normally discharged even after a cleaning operation, for example, that forcibly vacuums ink from within the ink path when the recording head is used the next time. This tendency is particularly pronounced with pigment inks that easily increase in viscosity, and pigment inks are increasingly used in order to achieve a desired print quality.

There is therefore a strong need for an inkjet recording head whereby this increase in ink viscosity can be prevented during extended storage.

It is also desirable in achieving a means for solving this problem to minimize the number of parts and achieve high precision and quality with the simplest possible method.

The present invention is directed to solving these problems and an object of the invention is to provide an inkjet recording head and an inkjet recording apparatus capable of preventing an increase in ink viscosity inside the flow paths during long term storage.

SUMMARY OF THE INVENTION

To achieve this object in a liquid jet head having nozzle openings, a pressure generation chamber communicating with each nozzle opening, a liquid reservoir for storing liquid supplied to pressure generation chambers, a liquid path unit including the pressure generation chambers and a seal plate for covering an opening to the liquid reservoir, and a head case to which the liquid path unit is bonded, a liquid jet head according to our invention provides a damper chamber at a part corresponding to the liquid reservoir in the head case or seal plate for releasing pressure change in the liquid reservoir; a release path formed in the head case for releasing pressure in the damper chamber to the air; and a control path imparted with specific flow resistance formed in the head case and/or seal plate for restricting moisture dispersion while communicating the damper chamber with the release path.

In other words, a liquid jet head according to the present invention has a damper chamber for releasing pressure change in the liquid reservoir formed at a part corresponding to the liquid reservoir in the head case or seal plate; a release path formed in the head case for releasing pressure in the damper chamber to the air; and a control path with specific flow resistance formed in the head case and/or seal plate to restrict moisture dispersion while communicating the damper chamber with the release path.

The flow of water vapor from the liquid that passes through the seal plate is therefore restricted by the flow resistance of the control path, and undesirable dispersion of moisture from the liquid is thus suppressed.

Because the outflow of vapor to the air is restricted by the control path, evaporation of moisture from liquid in the liquid reservoir is restricted by the control path and an increase in the viscosity of liquid in the liquid reservoir is prevented even when the recording head is stored unused for a long time. Therefore, when the recording head is used again after being stored for a long time the liquid can be normally discharged after applying a normal cleaning operation, and discharge problems such as conventionally occur can be substantially eliminated.

Preferably, the control path of this liquid jet head is formed in an interfacial surface between the seal plate and head case.

The control path can be easily formed in these opposing surfaces, thus helping to improve the efficiency of recording head production.

Further, preferably the control path is formed in the seal plate.

In this case the depth of the control path is at most the thickness of the seal plate, and a high precision control path can therefore be formed using a press or other simple technique.

In another preferable embodiment the control path is formed in the head case.

In this case the control path can be formed by molding or other process at the same time the head case is manufactured, further contributing to efficient production.

Yet further preferably the seal plate of the liquid jet head has a barrier thin film and a path formation thin film in which the control path is formed.

Because the control path is formed in a thin film for forming the path, for example, the control path can be formed easily.

Further preferably in this case the barrier thin film is made from a resin thin film material, and the liquid path formation thin film is made from a metal thin film material.

Because the control path is formed in a metal thin film in this case the control path can be formed with high precision using a simple method, and the evaporation of liquid vapor can be restricted under optimal conditions.

Yet further preferably the control path is formed in the metal thin film using an etching process.

The etching process can be controlled to achieve a control path with high shape and dimensional precision, and the evaporation of liquid vapor can be restricted under optimal conditions.

Yet further preferably, the flow resistance is set to a permeability characteristic lower than the moisture permeability of the resin thin film.

The flow resistance imparted by this permeability characteristic assures reliable control and restriction of liquid vapor dispersion and evaporation as described above.

The flow resistance of the control path in the present invention is based on the following equations for vapor flow Q per unit time, $$Q=(W0-W1)/R$$

where W0 is the vapor density at the path inlet, W1 is the vapor density at the path outlet, and R is the flow resistance of the path.

$$R=L/(D\times S)$$

where L is the length of the path, D is the vapor dispersion coefficient, and S is the section area of the path.

The major factors determining flow resistance are the above L and S.

Further preferably, the resin thin film is a polyphenylene sulfide film.

In this case the moisture permeability of the film itself works ideally in conjunction with the permeability characteristic of the control path, and the dispersion of moisture vapor can be optimally controlled.

Yet further preferably the liquid jet head of this invention also has a connection cavity communicating with the damper chamber formed or connected to the damper chamber, and the connection cavity is disposed to the head case and/or seal plate and communicates with the control path.

In this case alignment error in the relative positions of the control path and damper chamber when the dimensionally precise control path is connected to the damper chamber can be absorbed by the connection cavity. This absorption of alignment error also absorbs misalignment when the seal plate is bonded to the head case, and effectively improves production efficiency.

Further preferably, connection cavities disposed to each of multiple damper chambers communicate with each other.

This configuration enables multiple damper chambers to communicate through the control path with the release path by means of a simple structure. Furthermore, when the damper chambers thus communicate with the release path through multiple control paths from the connection cavities communicating with the damper chamber, communication between the multiple damper chambers and the air is maintained by the remaining good control paths when flow through part of the control paths becomes obstructed for some reason, and a worst-case increase in the liquid viscosity can also be avoided.

Yet further preferably the seal plate is bonded to the head case using adhesive, and a cavity for holding excess adhesive is formed at least in proximity to the control path.

If excessive adhesive is applied this configuration captures the excess adhesive in this cavity and prevents the adhesive from flowing into the control path. Furthermore, even if some adhesive gets into the control path the amount will be within the allowable range and normal flow through the control path can be assured.

Further preferably this cavity communicates with the control path.

With this configuration excess adhesive is captured and held in the cavity communicating with the control path. The amount of adhesive penetrating the control path can therefore be minimized and the control path can be kept clear and functional.

Further preferably, the cavity for holding excess adhesive is narrower in width than the control path and communicates with the control path.

By making the cavity for holding excess adhesive narrower than the control path, the likelihood of the control path becoming plugged with adhesive can be reduced.

Further preferably the liquid jet head discharges a pigment ink.

Pigment type inks are particularly susceptible to an increase in viscosity due to evaporation of moisture from the ink. By effectively preventing the evaporation of moisture from ink in the liquid reservoir, the present invention is therefore particularly effective as a means enabling the recording head to be used smoothly again after having been stored for a long time.

The pressure generation element of a liquid jet head according to the present invention is preferably a piezoelectric transducer.

It is therefore possible to prevent evaporation of moisture from liquid in the liquid reservoir of a recording head using a piezoelectric transducer as the pressure generation means, and enable the recording head to be used smoothly again after having been stored for a long time.

Further preferably, the pressure generation element is a longitudinal oscillation mode piezoelectric transducer.

Because resin films such as polyphenylene sulfide films that pass water vapor easily are commonly used as the seal plate in recording heads that use a longitudinal oscillation mode piezoelectric transducer, this configuration of our invention can effectively prevent evaporation of moisture from liquid in the liquid reservoir, and can therefore enable the recording head to be used smoothly again after having been stored for a long time.

Yet further preferably the piezoelectric transducer is contained in the head case and applies a pressure change to the pressure generation chamber.

This configuration helps improve production efficiency because the head case is used both to secure the piezoelectric transducer and to form the control path.

Preferably, the pressure generation element of the recording head is a heating element for heating liquid in the liquid path.

With this configuration the invention can effectively prevent evaporation of moisture from liquid in the liquid reservoir of a recording head using a heating element as the pressure generation means, and can therefore enable the recording head to be used smoothly again after having been stored for a long time.

Alternatively, the control path formed in the liquid path formation thin film is a straight release path enabling the connection cavity and release path to communicate in a straight line.

Because there are no curves in the control path with this configuration, it is difficult for adhesive to collect inside the control path.

Further preferably, a seal plate cavity is formed in the seal plate at a position appropriate to the liquid reservoir, the seal plate cavity is formed in the liquid path formation thin film, and a part of the seal plate cavity disposed in proximity to the straight release path formed in the liquid path formation thin film and opposite the straight release path is substantially parallel to the straight release path.

With this configuration the seal plate cavity and straight release path are formed by removing at least a part of the liquid path formation thin film. The rigidity of the seal plate cavity and straight release path is therefore weaker than where these parts are not formed and this part is susceptible to wrinkling.

In addition, the part of the seal plate cavity and straight release path disposed in proximity to the easily wrinkled part is even more susceptible to wrinkles.

Therefore, by forming the part of this seal plate cavity that is opposite the straight release path so that it is parallel to the straight release path, external force is applied evenly and not concentrated to one side, thereby reducing susceptibility to wrinkling.

Further preferably a bonding pad is formed in the seal plate cavity.

When the seal plate is bonded to the pressure generation chamber and liquid reservoir opening, this configuration can firmly hold the seal plate at the bonding pad, thereby reducing the likelihood of bonding defects.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 1 is a partially exploded oblique view of a first embodiment of an inkjet recording head according to the present invention;

DESCRIPTION OF THE PREFERRED EMBODIMENTS

Preferred embodiments of the present invention are described below with reference to the accompanying figures. It will be noted that because the embodiment described below is a preferred embodiment of the invention various technically desirable limitations are also described, but unless otherwise specifically noted the scope of the present invention shall not be limited to the embodiments described below.

Embodiment 1

Figure 2:
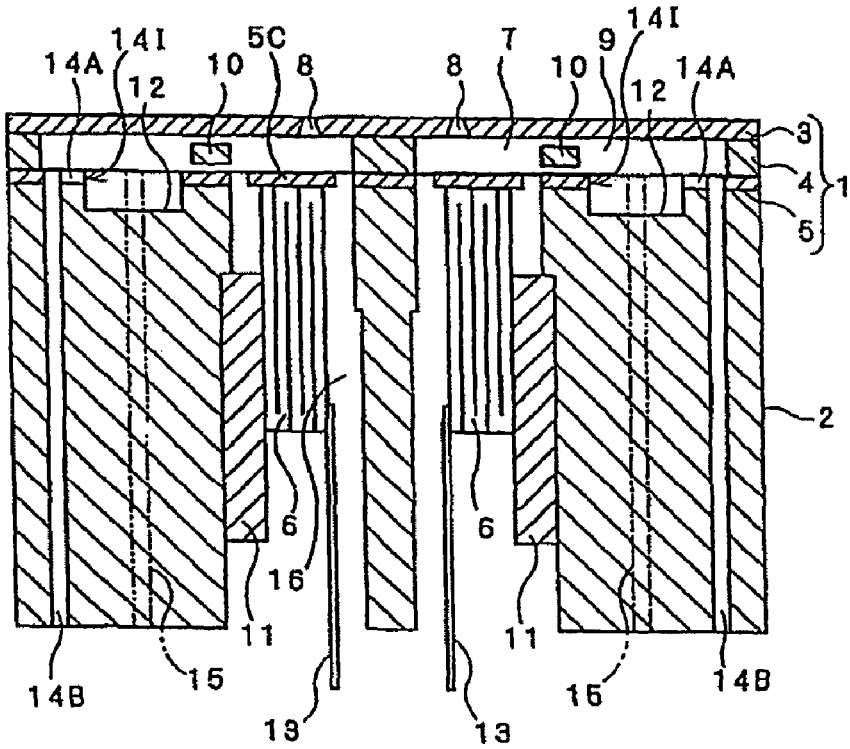
FIG. 2 is a section view of the inkjet recording head shown in FIG. 1.
Figure 3:
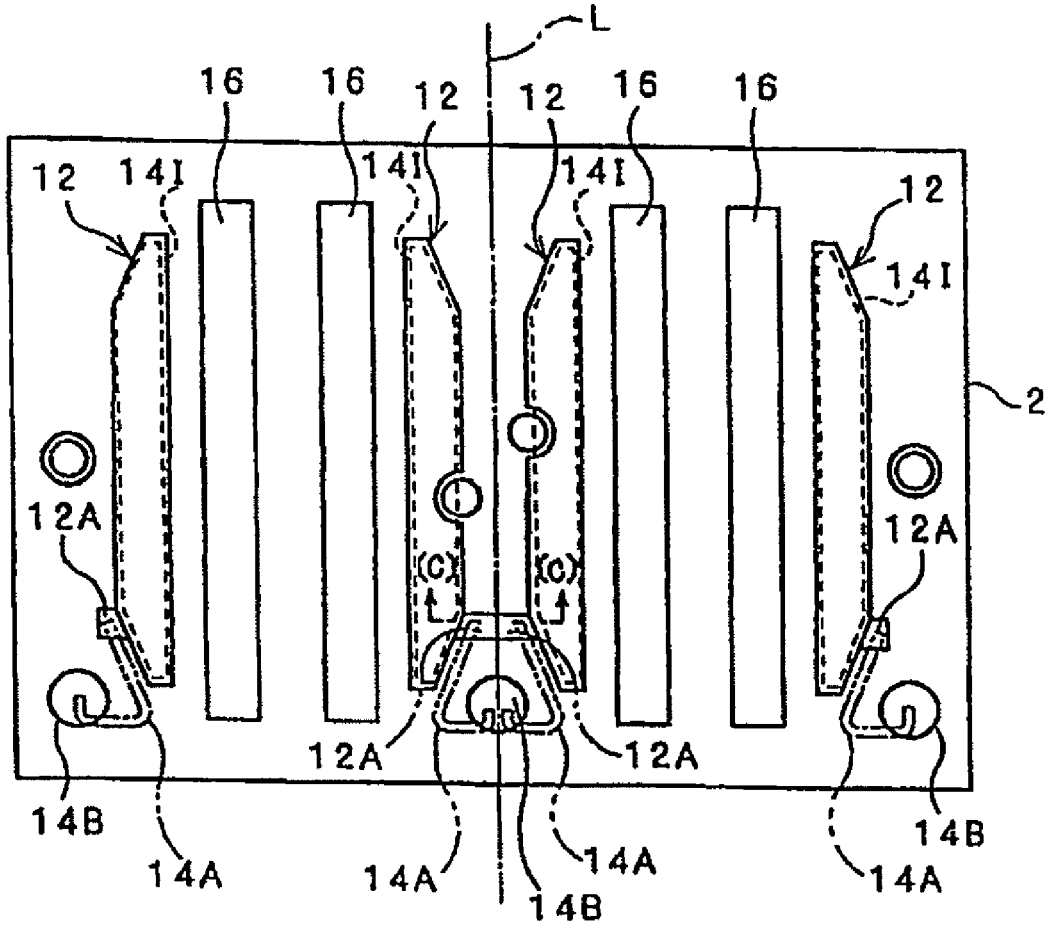
FIG. 3 is a plan view of just the head case in the inkjet recording head shown in FIG. 1.

FIG. 1 to FIG. 7 show an inkjet recording head (referred to below as simply a recording head) as a first embodiment of an inkjet recording head disposed to an inkjet recording apparatus according to the present invention. This recording head is basically the same as the recording head shown in FIG. 16, and like parts are therefore identified by like reference numerals below. Furthermore, while there are two rows of nozzle openings 8 and pressure generation chambers 7 in the recording head shown in FIG. 16, there are four such rows in the head case 2 shown in FIG. 3. More specifically, the section through either side of the dot-dash line L in FIG. 3 corresponds to the views shown in FIG. 1, FIG. 2, and FIG. 16. FIG. 3 is a top plan view of the head case 2.

The ink path unit 1 is a laminar construction including a nozzle plate 3 to which nozzle openings 8 are disposed in rows, a flow channel substrate 4 in which rows of pressure generation chambers 7 each communicating with a corresponding nozzle opening 8 are disposed and in which is formed ink reservoirs 9 for holding ink for supply to each of the pressure generation chambers 7 through an ink supply path 10, and a diaphragm 5 (seal plate) for covering the bottom openings of the pressure generation chambers 7 and ink reservoirs 9. In FIG. 3 the damper chambers 12 in the middle are positioned in a mutually compatible shape, and there is a corresponding space 16 for each damper chamber 12.

The head case 2 is injection molded from a thermosetting resin or thermoplastic resin. The piezoelectric transducers 6 are housed in the vertically through-passing spaces 16 at positions corresponding to the pressure generation chambers 7. The spaces 16 extend in line with the rows of nozzle openings 8 and are disposed corresponding to these rows. The piezoelectric transducers 6 are longitudinal oscillation mode transducers, the back end side of which is bonded to the fixed plate 11 affixed to the head case 2, and the front end surface is bonded to a pad 5C on the bottom surface of the diaphragm 5.

The diaphragm 5 in this embodiment is made of polyphenylene sulfide (PPS) film laminated with a stainless steel pad 5C. Damper chambers 12 for absorbing pressure fluctuations inside the ink reservoirs 9 through the diaphragm 5 are formed in the head case 2 at locations appropriate to the ink reservoirs 9.

As shown in FIG. 1 to FIG. 3, a seal-side cavity such as diaphragm-side cavity 14I is disposed to the diaphragm 5 at positions corresponding to the damper chambers 12 disposed to the head case 2. As shown in FIG. 3, these diaphragm-side cavities 14I are substantially identical in shape to the damper chambers 12.

The diaphragm (seal) 5 is a laminate of a thin-film barrier such as resin thin film 5A and a thin film such as a metal thin film 5B for forming flow channels. The resin thin film 5A could be a polyphenylene sulfide (PPS) film. A stainless steel alloy is typically used for the metal thin film 5B. The diaphragm-side cavities 14I are formed in the metal thin film 5B, and are more specifically formed in the diaphragm (seal) 5 surface facing the head case 2.

The diaphragm 5 (seal) shall not be limited to this configuration and could be electroformed Ni or SUS, for example, or formed from dry film and resin film.

The ink used with an inkjet recording head is generally deaerated in order to prevent bubbles from forming. As a result, if the damper chamber 12 is an independent space that does not communicate with the exterior, air inside the damper chamber 12 can dissolve into the ink through the PPS film diaphragm 5, thereby lowering the pressure inside the damper chamber 12, increasing the tension of the diaphragm 5, and thus easily making it difficult to achieve the desired damping effect. This pressure drop inside the damper chamber 12 is therefore prevented by enabling the damper chamber 12 to communicate with the outside through an external communication path 14 disposed to the head case 2.

The piezoelectric transducers 6 are forced to expand and contract longitudinally by applying a drive signal generated by a drive circuit (not shown in the figure) to the piezoelectric transducers 6 by way of flexible printed circuit 13. Expansion and contraction of the transducers 6 causes the pad 5C of the diaphragm 5 to vibrate and change the pressure inside the pressure generation chamber 7 so that ink inside the pressure generation chamber 7 is discharged from the nozzle opening 8 as an ink droplet. Also shown in the figures are the ink refilling tubes 15 for refilling the ink reservoir 9 with ink from an ink cartridge (not shown in the figure), and ink refilling holes 20 disposed at corresponding positions to the ink refilling tubes 15 in the diaphragm 5.

The external communication path 14 includes a control path 14A to which flow resistance is applied to suppress ink evaporation, and release path 14B opening the control path 14A to the air. The control path 14A is designed so that the path area is small and the path curves in an optimal pattern. The flow resistance of the control path 14A itself is determined by appropriately determining the path area and the routing pattern. It should be noted that the exemplary control path 14A shown in these figures is shaped like the numeral 7.

As shown in FIG. 1 to FIG. 3, the control paths 14A are formed in the metal thin film 5B, and are more specifically formed in the surface of diaphragm 5 facing the head case 2 using an etching process.

It should also be noted that the control paths 14A could be formed on the head case 2 side rather than the diaphragm 5.

Figure 4:
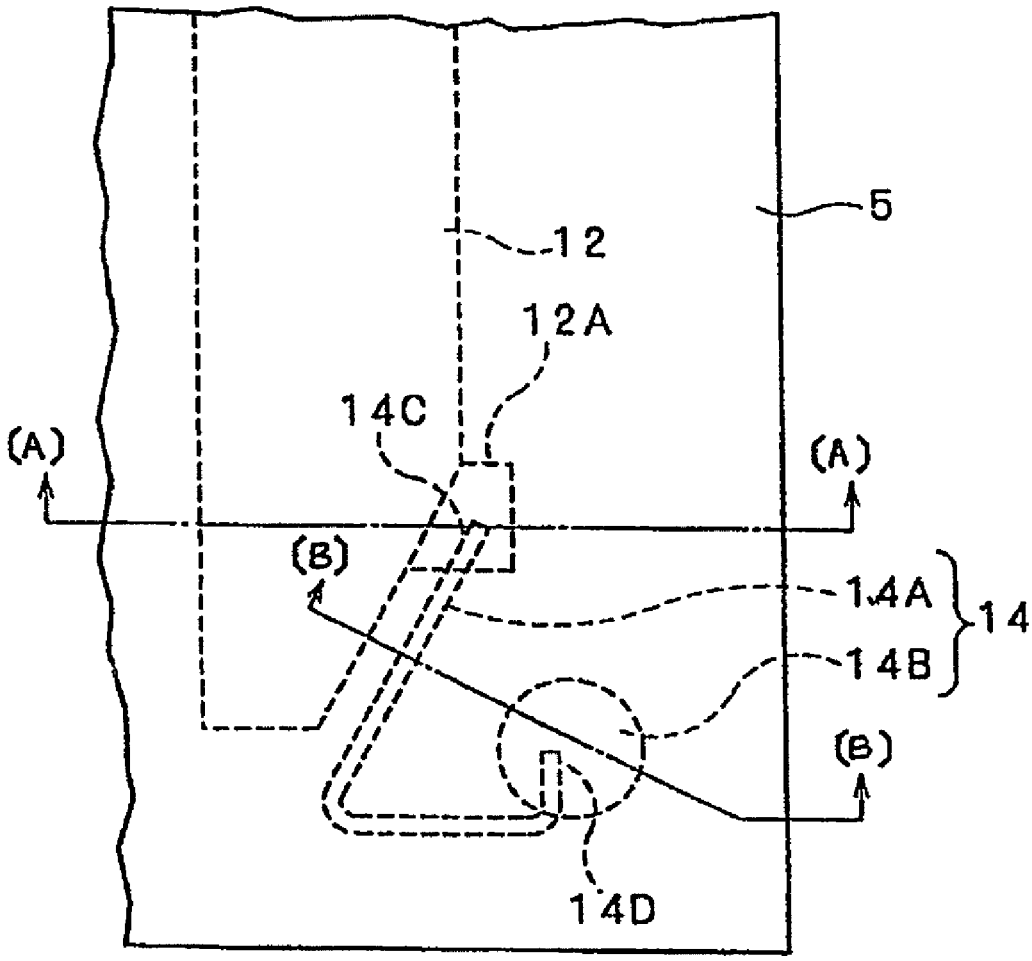
FIG. 4 is a plan view showing the diaphragm affixed to the head case.
Figure 5:
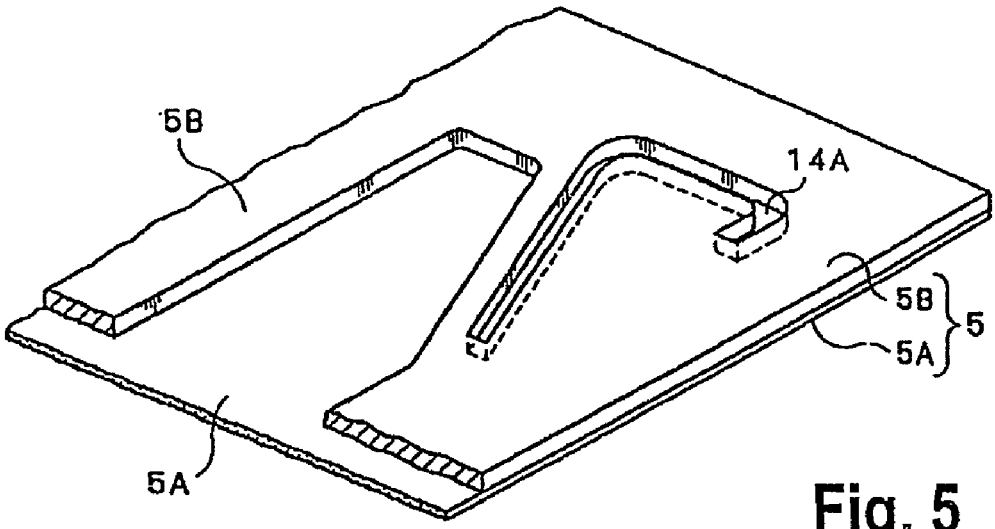
FIG. 5 is an oblique view showing the opposite side of the diaphragm.
Figure 6:
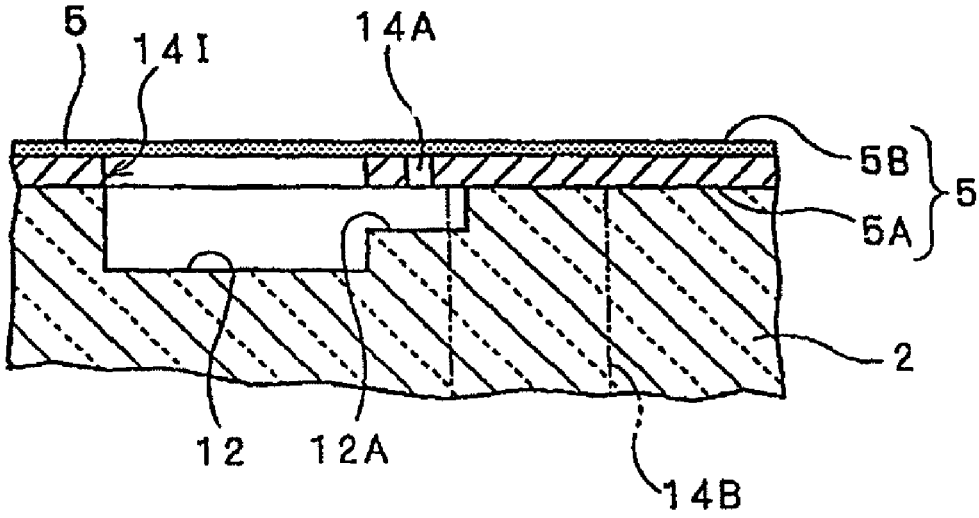
FIG. 6 is a section view through line (6)-(6) in FIG. 4.
Figure 7:
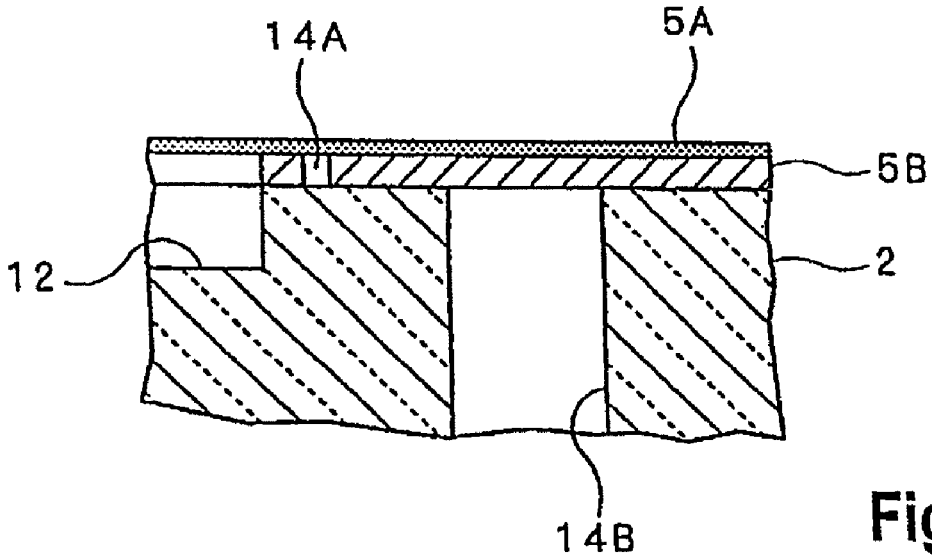
FIG. 7 is a section view through line (7)-(7) in FIG. 4.
Figure 16:
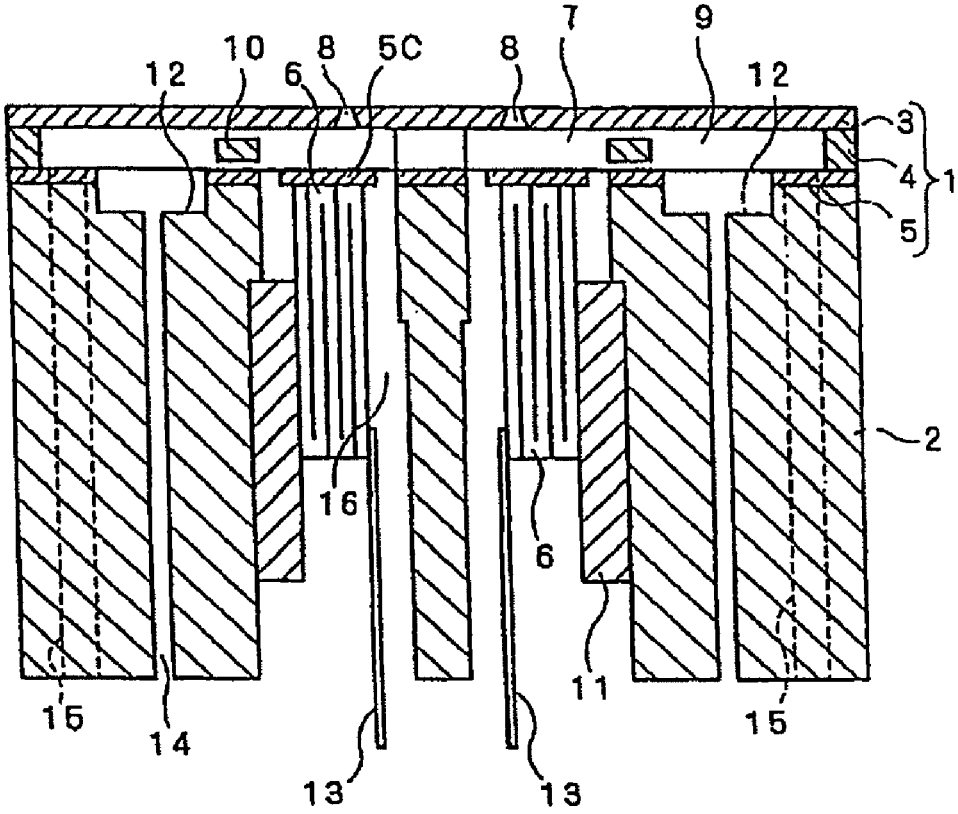
Fig. 16 PRIOR ART
FIG. 16 is a section view of a conventional inkjet recording head.
Figure 17:
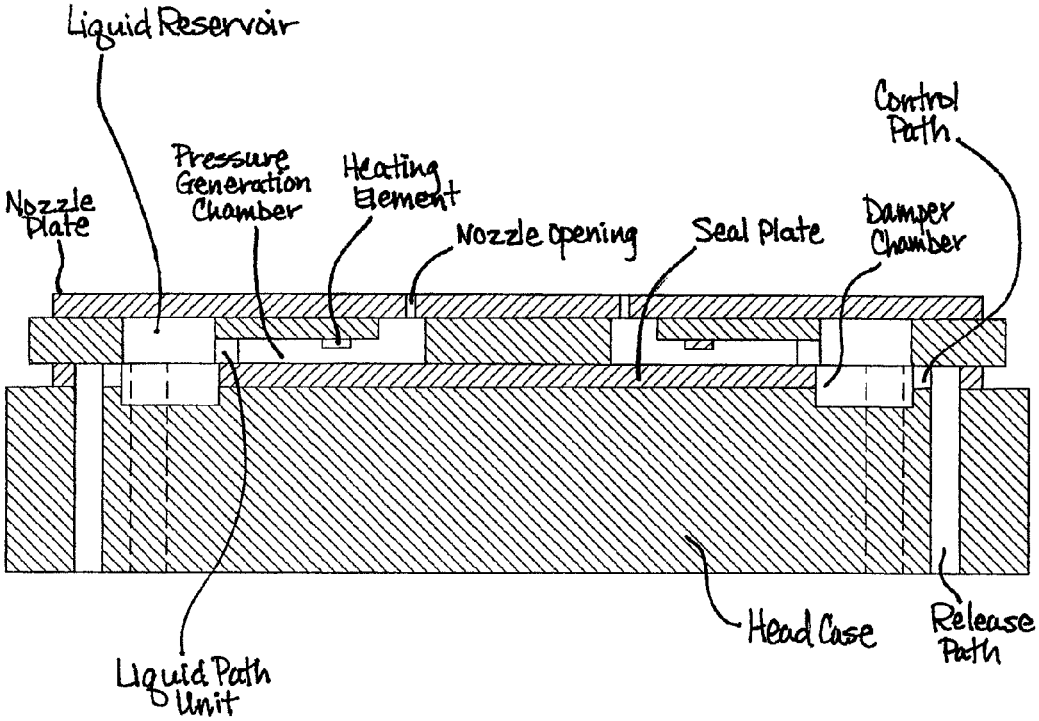
FIG. 17 is an illustration showing an ink jet recording head in accordance with the present invention showing a heating element used as the transducer.

The release path 14B is formed in the head case 2 and is identical to the air hole provided by the external communication path 14 shown in FIG. 16. That is, the release path 14B forms a ventilation hole with a large internal diameter and passes through the head case 2 in the top to bottom direction as seen in FIG. 2. The release path 14B itself is not used to restrict the flow of ink vapor. Note that FIG. 4 is a plan view showing the layout with the nozzle plate 3 and flow channel substrate 4 removed for easier understanding.

As noted above the diaphragm (seal) 5 is a laminate of a resin thin film 5A and a metal thin film 5B. The resin is typically a PPS film and the metal is typically a stainless steel alloy, for example. The control path 14A is formed in the metal thin film 5B, and more specifically on the surface of the diaphragm (seal) 5 facing the head case 2.

Various methods can be used to form the control path 14A, but an etching process as noted above is ideal. The dimensional specifications of the control path 14A can be optimally selected according to the specifications of the recording head, and the control path 14A in this example is designed to a depth (that is, thickness of the thin film 5A) of approximately 0.03 mm and a width of approximately 0.3 mm. The control path 14A shall also not be limited to the above-described shape of the numeral 7, and could be S-shaped, zigzag, or otherwise configured to match the vapor permeability of the diaphragm 5. Note that in this case the sectional area of the control path 14A is a determining factor of the path resistance.

A connection cavity 12A is formed in the damper chamber 12 to connect and enable communication between the damper chamber 12 and control path 14A. The connection cavity 12A is formed as a partial extension of the space in the damper chamber 12. More specifically, the connection cavity 12A is formed in the head case 2 by removing a part of the inside wall of the damper chamber 12. When seen in plan view as shown in FIG. 4, the area of the damper chamber 12 is significantly greater than the width of the control path 14A.

The release path 14B is opened in the head case 2. As will also be known from FIG. 4, the sectional area of the release path 14B is significantly greater than the width of the control path 14A disposed in the diaphragm 5. The one end 14C of the control path 14A overlaps and communicates with connection cavity 12A. The other end 14D of the control path 14A similarly overlaps and communicates with the release path 14B.

It should be noted that the connection cavity 12A is disposed to the head case 2 in this embodiment because it is bonded with an adhesive applied to the head case 2, but the connection cavity 12A could alternatively be formed in the metal thin film 5B of diaphragm 5 [3, sic] using an etching process.

In this first embodiment of the invention water vapor from ink stored in the damper chamber 12 gradually flows through connection cavity 12A into the control path 14A. Because the flow resistance of the control path 14A is high, that is, because the vapor permeability characteristic of the control path 14A is set lower than the vapor permeability of the thin film 5A of the diaphragm 5, the flow of water vapor from the ink is restricted by the control path 14A.

Because the outflow of water vapor to air is restricted by the control path 14A as described above, evaporation of moisture from the ink in the ink reservoir 9 is restricted by the control path 14A even when the recording head is stored for a long time, and an increase in ink viscosity in the ink reservoir 9 is thereby suppressed. When the recording head is then used again after being stored for some time, ink can be normally discharged after applying a normal cleaning operation, and discharge problems such as conventionally occur are substantially eliminated.

The control path 14A can be formed to a precise shape and dimensions by etching the control path 14A into the metal thin film 5B, and this technique is therefore ideal for imparting the appropriate flow resistance to the control path 14A. Furthermore, because the connection cavity 12A is disposed to the damper chamber 12, the size of the connection cavity 12A relative to the control path 14A enables the connection cavity 12A to absorb alignment error when the control path 14A and head case 2 are bonded, thus simplifying process management and precision control during manufacturing.

Embodiment 2

Figure 8:
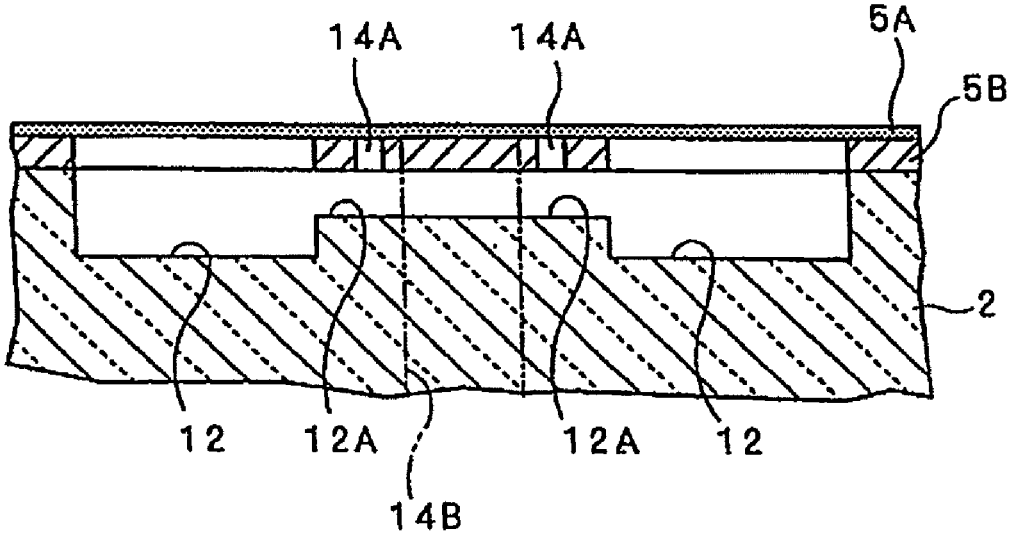
FIG. 8 is a section view through line (8)-(8) in FIG. 3, and shows a second embodiment of the present invention.

A second embodiment of the present invention is described with reference to FIG. 3 and FIG. 8. In this embodiment the connection cavities 12A of plural damper chambers 12 communicate with each other. As a result two control paths 14A communicate with the mutually communicating connection cavities 12A as will be clear from the double-dot dash line in FIG. 3. The other ends of the two control paths 14A are connected to one release path 14B. It is also possible to use only one or to use three or more control paths 14A.

Because connection cavities 12A communicate with each other in this embodiment, ink vapor from two damper chambers 12 can be conducted with a simple construction. In addition, when a problem occurs with flow through one control path 14A, deficient yet minimal flow control is sustained by the other control path 14A. Ink viscosity can therefore be prevented from reaching a worst-case condition, and a pressure drop in the damper chambers can be suppressed.

Embodiment 3

Figure 9:
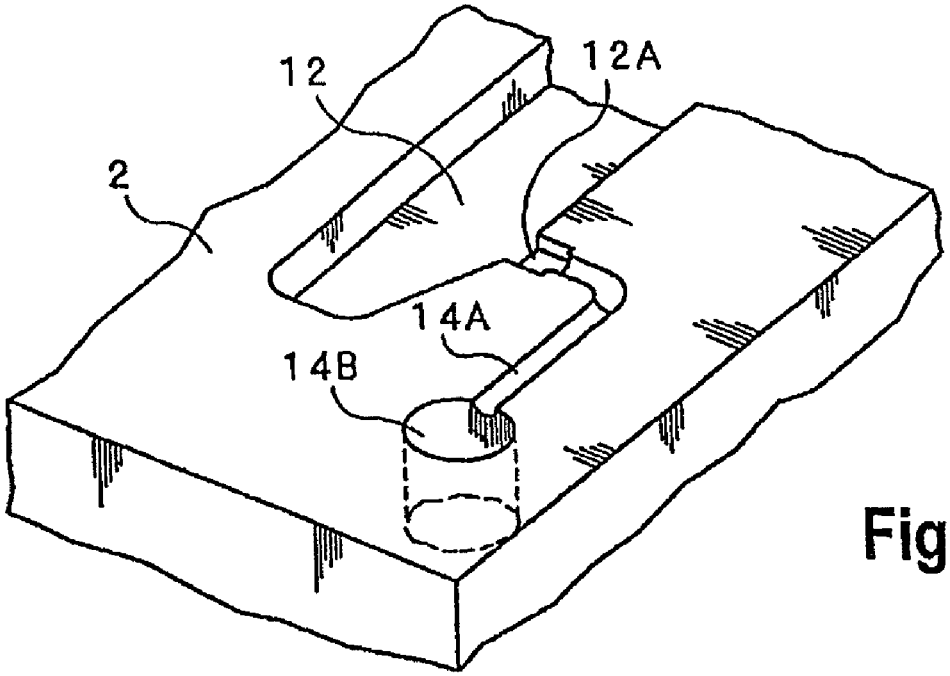
FIG. 9 is an oblique viewing showing a third embodiment in which the control paths are formed on the head case side.
Figure 10:
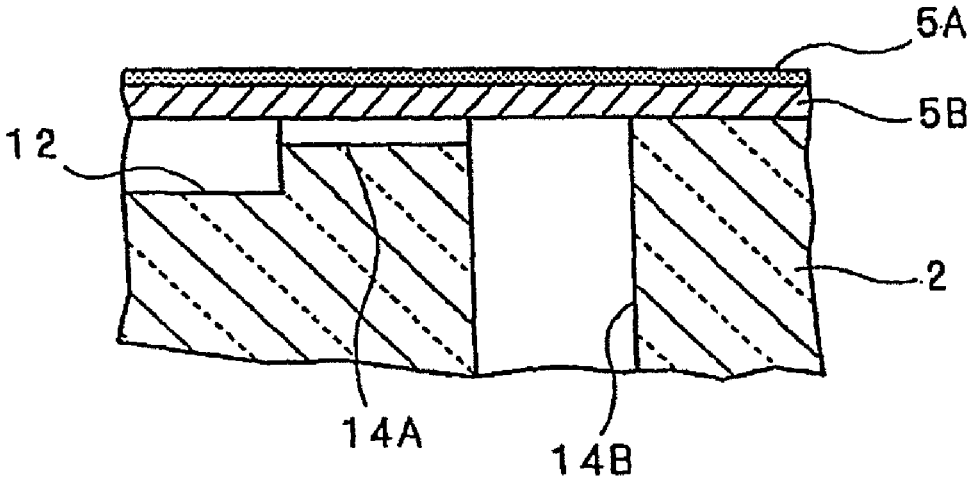
FIG. 10 is a section view showing a variation of a configuration in which the control paths are formed on the head case side.

A third embodiment of the invention is shown in FIG. 9 and FIG. 10. In this embodiment the control paths 14A are formed in the head case 2. FIG. 9 shows the control path 14A inset into the surface of the head case 2 facing the diaphragm (seal) 5. FIG. 10 shows the control path 14A disposed as a narrow ventilation hole in the head case 2. Note that a connection cavity 12A is not present in the configuration shown in FIG. 10. This embodiment is advantageous in terms of manufacturability because the control path 14A can be formed at the same time the head case 2 is manufactured.

Embodiment 4

A fourth embodiment of the invention is described with reference to FIG. 11. This embodiment has two variations, the first shown in FIG. 11 (A).

This first variation of the fourth embodiment prevents the adhesive used to bond the ink path unit 1 and head case 2 from flowing into the control path 14A, and has cavities 17 for holding any excess adhesive. In this example there are three cavities 17, each branching off from and communicating with control path 14A. The control path 14A also passes completely through and beyond the connection cavity 12A to form an extension 17A, and likewise passes through and beyond the release path 14B to form another extension 17B at the opposite end. These extensions 17A and 17B can also be used as storage cavities for excess adhesive.

These cavities 17, 17A, and 17B can be simultaneously formed when forming the control path 14A with an etching process.

Excess adhesive tends to collect easily in the dead-end parts of the cavities 17, thus making it more difficult for excess adhesive to collect in the control path 14A.

The cavities 17 can also be made narrower than the control path 14A. This further lowers the possibility of the control path 14A being clogged with adhesive.

Figure 11A:
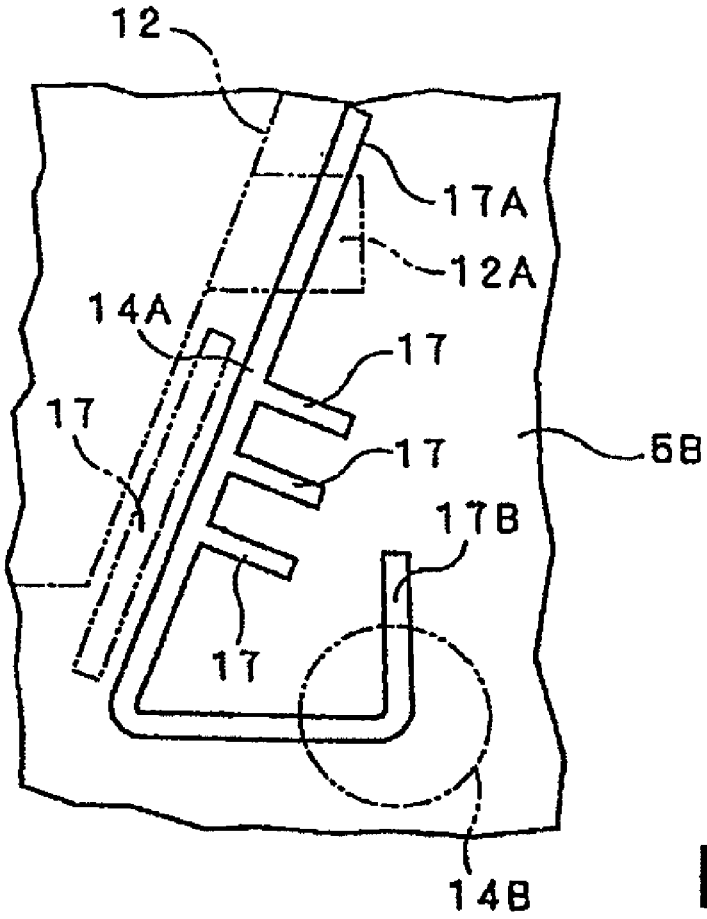
FIG. 11(A) is a plan view of a diaphragm according to a first variation in accordance with a fourth embodiment of the invention.
Figure 11B:
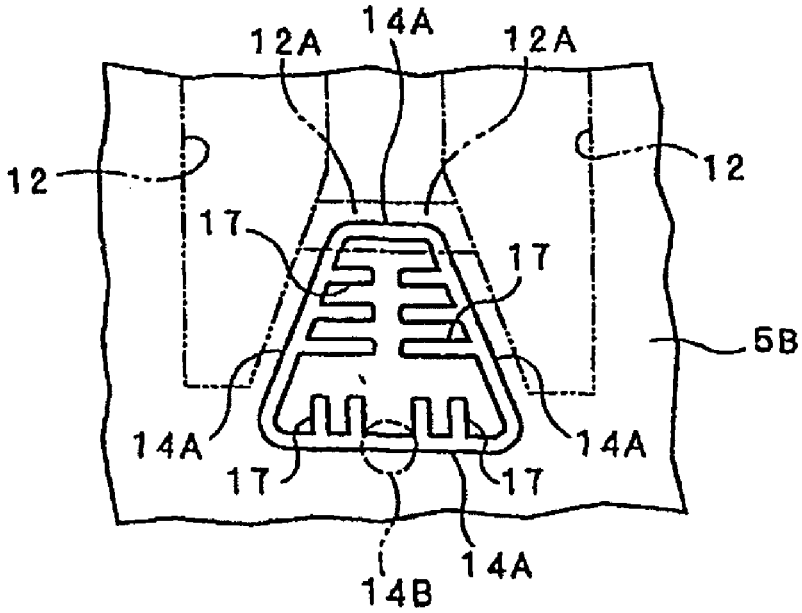
FIG. 11(B) is a plan view of a diaphragm according to a second variation in accordance with a fourth embodiment of the invention.

Cavity 17 shown with a double-dot dash line in FIG. 11 (A) is independent of the control path 14A. It should be noted that the cavities 17 for holding excess adhesive shall not be limited to a narrow trench shape as described above, and could be a circular, square, or otherwise shaped cavity of a suitable area.

The second variation of this fourth embodiment is shown in FIG. 11 (B). In this variation the control path 14A is a trapezoidally shaped endless path suitable for where mutually communicating connection cavities 12A connect with the release path 14B. A plurality of cavities 17 such as described above and shown in FIG. 11 (A) are formed on the inside of this trapezoidal control path 14A.

If too much adhesive is applied when bonding the ink path unit 1 and head case 2 together and there is excessive adhesive, the excess collects in the cavities 17 in this embodiment and adhesive is thereby prevented from flowing into the control path 14A. Furthermore, even if some adhesive flows into the control path 14A, interference with flow through the control path 14A is minimized.

Figure 12:
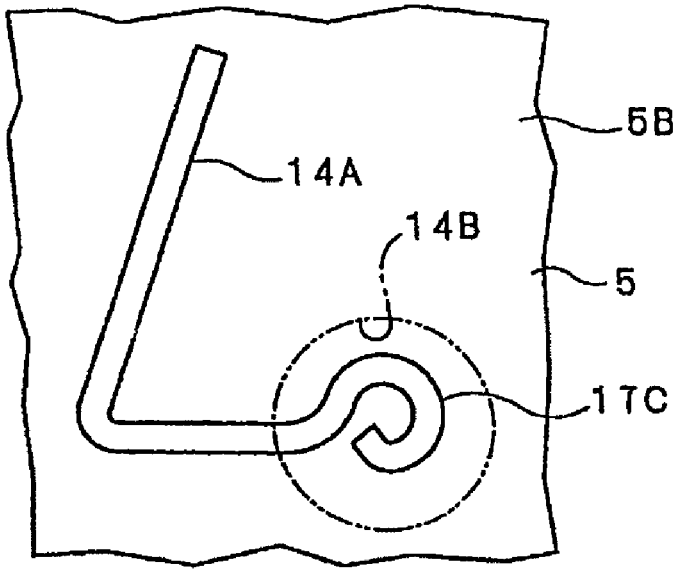
FIG. 12 is a plan view showing a variation of the connection between the control path and release path.

Various configurations can be used to connect the end of the control path 14A with the release path 14B. One example is a hooked end 17C such as shown in FIG. 12. This configuration assures dependable communication between the control path 14A and release path 14B even if the diaphragm 5 and release path 14B are slightly misaligned, and thus simplifies precision control during manufacturing.

Figure 13:
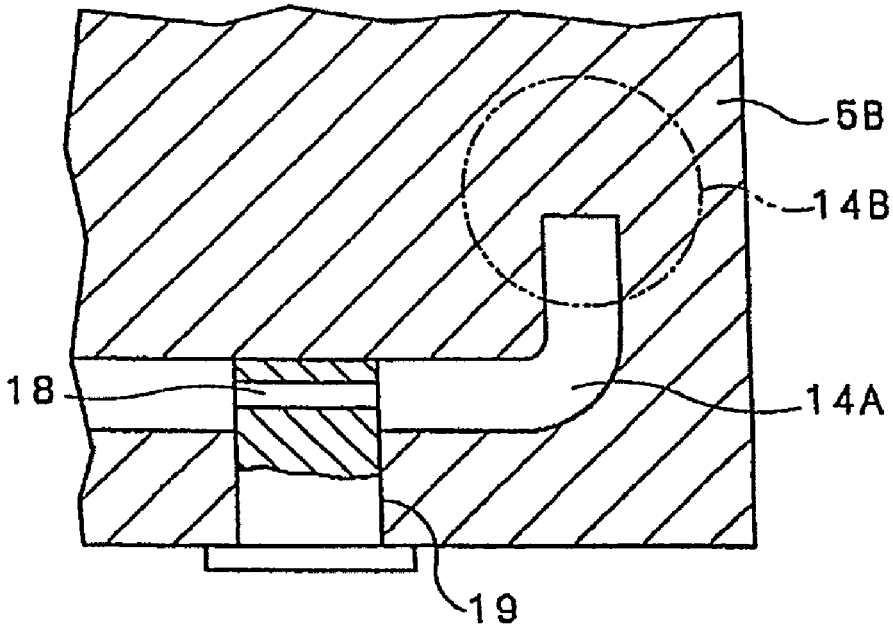
FIG. 13 is a side section view showing a control path in which a separate orifice is used.

The control path 14A is designed with a specific fine shape and sectional area determining the flow resistance, but it is alternatively possible to set the flow resistance of the control path 14A by inserting an orifice 18 such as shown in FIG. 13. In this case the control path 14A is formed to a somewhat large sectional area and a separate orifice element 19 plate is then inserted from the outside.

Embodiment 5

Figure 14:
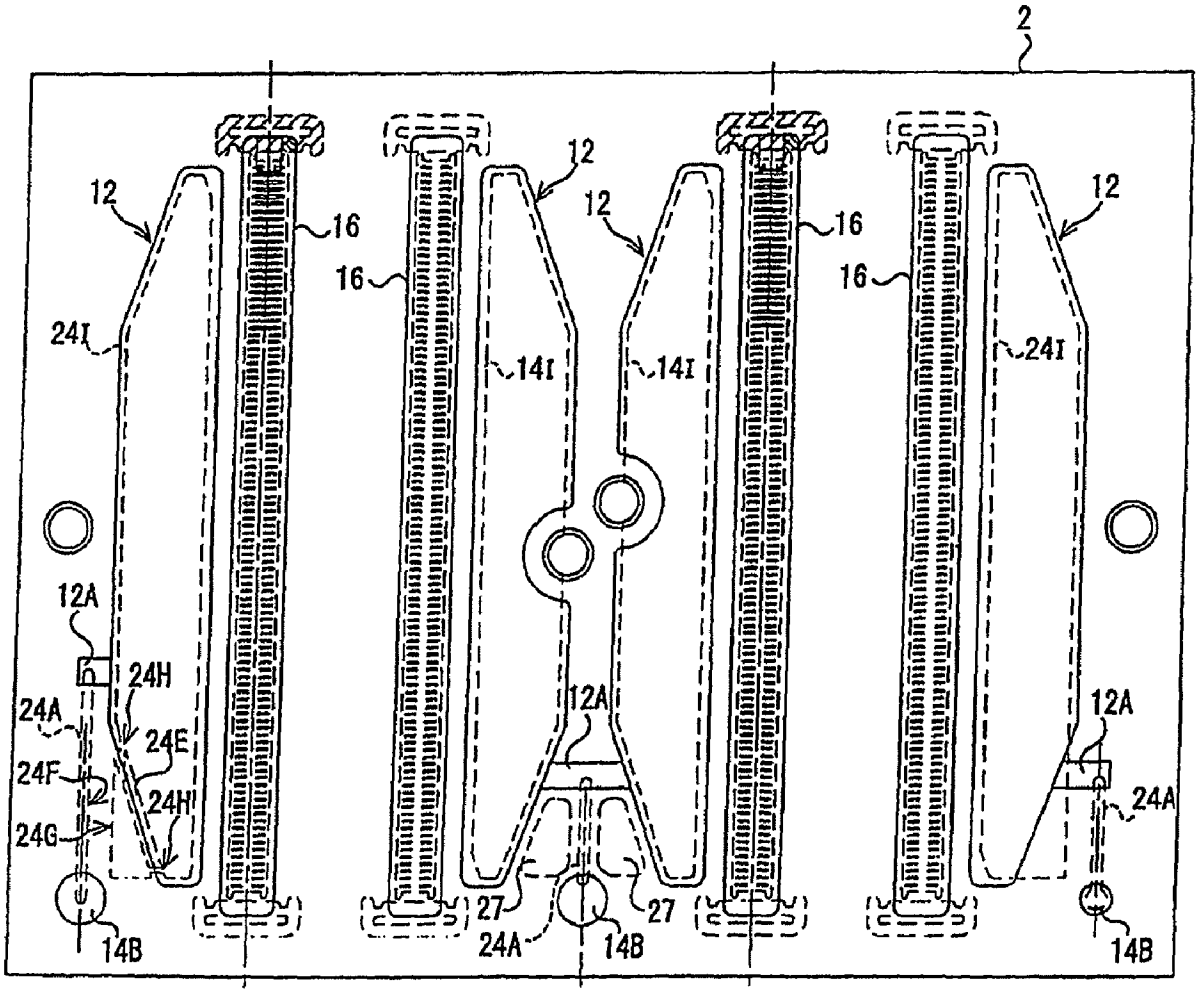
FIG. 14 is a schematic diagram showing the main parts of a recording head according to a fifth embodiment of the invention.

FIG. 14 is a schematic diagram showing the major parts of a recording head according to a fifth embodiment of the invention.

The configuration of an inkjet recording head according to this embodiment is substantially the same as the inkjet recording head according to the first and second embodiments described above. Like parts are therefore identified by like reference numerals and further description thereof is omitted below where primarily the differences are described.

FIG. 14 is a schematic plan view of the head case 2. The control path 24A formed in the metal thin film 5B of diaphragm 5 is a straight open channel enabling the connection cavity 12A and release path 14B to communicate in a straight line.

Unlike the control path 14A of the first embodiment, this control path 24A therefore does not have any curves. It is therefore difficult for excess adhesive to collect in the control path 14A when the ink path unit 1 shown in FIG. 1 is bonded to the head case 2.

A common connection cavity 12A is also formed at the bottom part of the two middle damper chambers 12 as shown in FIG. 14, and a straight release path 24A enabling connection cavity 12A and release path 14B to communicate in a straight line is also provided.

Because the release path 24A is thus straight, a space results in the part enclosed by the connection cavity 12A, damper chamber 12, and release path 14B, unlike the configuration shown in FIG. 3. This embodiment uses this space to provide one or more adhesive cavities 27 for holding excess adhesive. Two cavities 27 are formed in this embodiment.

When too much adhesive is applied when bonding the ink path unit 1 to the head case 2, the excess adhesive is held in the adhesive cavities 27 in the present embodiment. This prevents the adhesive from flowing into the control path 24A [14A, sic] and minimizes any flow interference in case adhesive does enter the control path 24A.

A diaphragm-side cavity 24I is also disposed near the left-side control path 24A, for example, in FIG. 14. The part of this diaphragm-side cavity 24I opposite the control path 24A is substantially parallel to the control path 24A.

More specifically, the right side surface 24F of the control path 24A in FIG. 14 is disposed substantially parallel to the left side surface 24G at the bottom left end of the diaphragm-side cavity 24I. The control path 24A and diaphragm-side cavity 24I are made from only the resin thin film 5A with an etching process removing the metal thin film 5B of the diaphragm 5 as shown in FIG. 2.

The parts where the control path 24A and diaphragm-side cavity 24I are formed are therefore less rigid than the surrounding parts, and are easily wrinkled when external force is applied. Moreover, the part where the easily wrinkled control path 24A and diaphragm-side cavity 24I are juxtaposed wrinkles even more easily.

However, by arranging the opposing control path 24A and right-side surface 24F, and the left-side surface 24G at the bottom left part of the diaphragm-side cavity 24I in this easily wrinkled area so that they are parallel, external force is not concentrated at one part but is applied uniformly. Rigidity is thus improved and wrinkles do not occur easily.

The part where the left-side surface 24G of the diaphragm-side cavity 24I in FIG. 14 is formed is segmented into a substantially triangular shape by the substantially rectangular bonding pad 24E.

More specifically, this bonding pad 24E is left after etching metal thin film 5B of diaphragm 5 while the ends of the bonding pad 24E are etched away, thus forming two channels 24H linking the substantially triangular part and the substantially trapezoidal diaphragm-side cavity 24I.

When the diaphragm 5 is bonded to, for example, the flow channel substrate 4 having openings to the pressure generation chamber and ink reservoir, the diaphragm 5 is typically held with a tool. Because the bonding pad of the present embodiment contacts the tool or other device at this time, the diaphragm 5 can be firmly bonded with good precision to the flow channel substrate 4.

Variation of Embodiment 5

Figure 15:
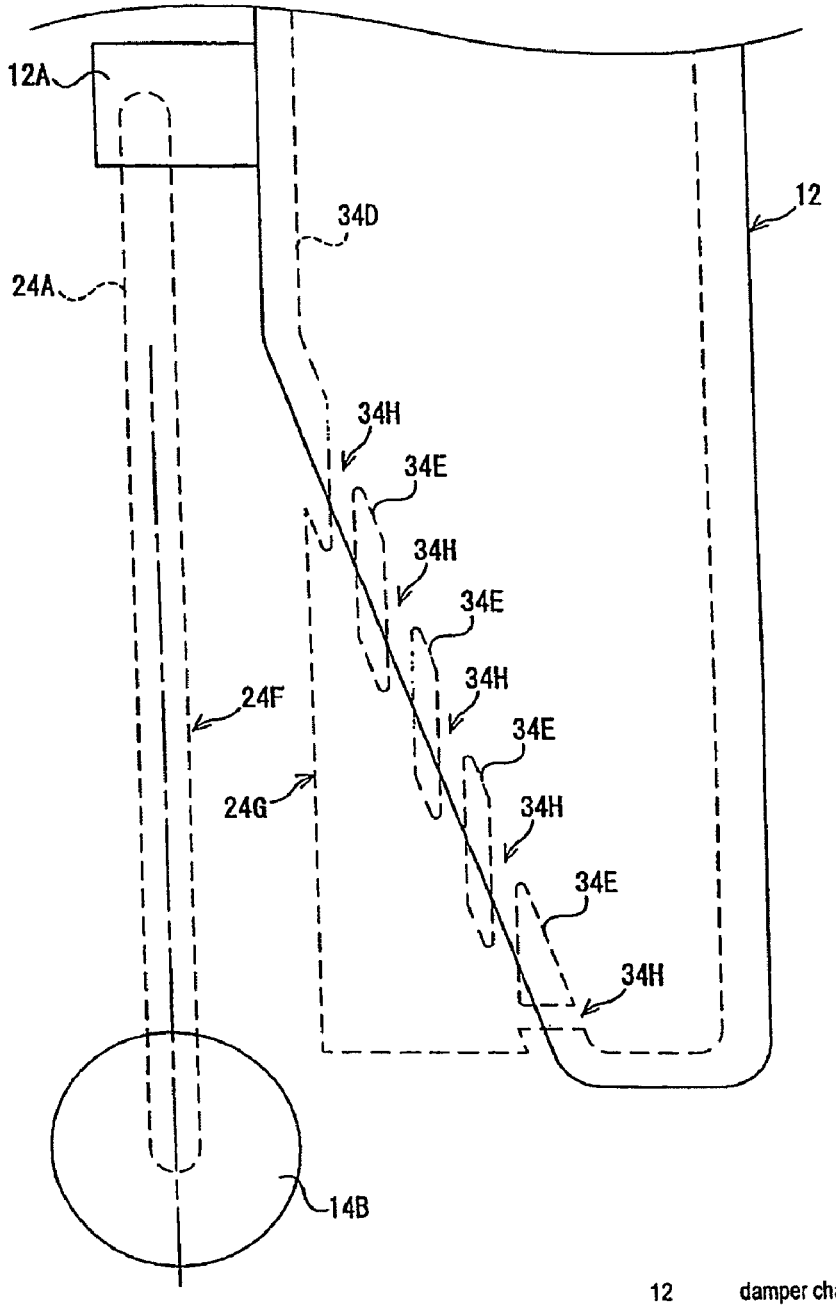
FIG. 15 is a schematic view showing a variation of the fifth embodiment.

FIG. 15 shows a variation of the fifth embodiment described above. This variation differs from the fifth embodiment shown in FIG. 14 only in the shape of the bonding pad 24E and is otherwise the same. Like parts are therefore referenced with like reference numerals and further description thereof is therefore omitted below where primarily the differences are described.

As shown in FIG. 15 the bonding pads 34E in the present embodiment differ from the bonding pad 24E in FIG. 14. More specifically, a plurality of slender individual bonding pads 34E are provided with a channel 34H between adjacent bonding pads 34E and at the ends. Note that in the example shown in FIG. 15 there are four bonding pads 34E and five channels 34H.

The bonding pads 34E are 0.1 mm or less wide. Making the bonding pads 34E narrow reduces interference with ink reservoir 9 compliance after bonding with the flow channel substrate 4.

It should be noted that while the present invention has been described with reference to a recording head using longitudinal oscillation mode piezoelectric transducers 6, the invention shall not be so limited. For example, the invention can be applied to a recording head using a deflection mode piezoelectric transducer, or to a recording head using a heating element for heating ink inside the ink path as the pressure generation element.

An inkjet recording head and inkjet recording apparatus according to the present invention as described above thus provide a control path through which the damper chamber communicates externally rather than opening the damper chamber directly to the air. Evaporation of moisture from ink held in the ink reservoir is thus restricted by this control path and an increase in the viscosity of ink in the ink reservoir is suppressed even when the recording head is stored without being used for a long time. Therefore, when the recording head is next used after being stored for a long time, ink can be discharged normally after performing a normal cleaning operation, and discharge problems such as conventionally occur are substantially eliminated.

Moreover, because formation of the control paths is important, it is not necessary to provide any additional special parts, and the invention thus offers the further advantage of a simple configuration.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An inkjet recording head comprising:

a first damper chamber and a second damper chamber;

a release path operatively associated with both the first damper chamber and the second damper chamber; and a first control path connecting the first damper chamber and the release path and a second control path connecting the second damper chamber and the release path.

2. The inkjet recording head according to claim 1, wherein the first damper chamber comprises an angled edge and the release path is located adjacent to the angled edge of the first damper chamber.

3. The inkjet recording head according to claim 1, wherein the first damper chamber and the second damper chamber each include an angled edge and the release path is located adjacent to the angled edges of the first damper chamber and the second damper chamber.

4. The inkjet recording head according to claim 3, wherein widths of the first damper chamber and the second damper chamber are decreased at the angled edges.

5. The inkjet recording head according to claim 1, wherein the first damper chamber and the second damper chamber have trapezoidal shapes.

6. The inkjet recording head according to claim 1, wherein the first control path and the second control path take an indirect route from the first damper chamber and the second damper chamber to the release path.

7. The inkjet recording head according to claim 1, wherein the release path is operable to restrict moisture dispersion.

8. The inkjet recording head according to claim 1, wherein an end of the first control path is connected to the release path at a portion of the release path other than a portion which faces the first damper chamber; and wherein an end of the second control path is connected to the release path at a portion of the release path other than a portion which faces the second damper chamber.

9. The inkjet recording head according to claim 1, wherein each of said first damper chamber and said second damper chamber comprises two sub-chambers separated by a film, wherein one of the sub-chambers is a liquid reservoir operable to store a liquid and the second sub-chamber is an air chamber operable to retain air.

10. An inkjet recording apparatus comprising the liquid jet head according to claim 1.

11. An inkjet recording head comprising:

a first damper chamber and a second damper chamber;

a release path operatively associated with the first damper chamber and the second damper chamber; and a first control path connecting the first damper chamber and the release path and a second control path connecting the second damper chamber and the release path, the first control path and the second control path being operable to restrict moisture dispersion;

wherein each of said first damper chamber and said second damper chamber comprises two sub-chambers separated by a film, wherein one of the sub-chambers is a liquid reservoir operable to store the liquid and the second sub-chamber is an air chamber operable to retain air;

wherein the first damper chamber and the second damper chamber each include an angled edge and the release path is located adjacent to the angled edges of the first damper chamber and the second damper chamber;

wherein widths of the first damper chamber and the second damper chamber are decreased at the angled edges; and wherein the first control path and the second control path take an indirect route from the first damper chamber and the second damper chamber to the release path.

12. The inkjet recording head according to claim 11, wherein an end of the first control path is connected to the release path at a portion of the release path other than a portion which faces the first damper chamber; and wherein an end of the second control path is connected to the release path at a portion of the release path other than a portion which faces the second damper chamber.

13. An inkjet recording apparatus comprising the liquid jet head according to claim 11.

* * * * *